US006049951A

United States Patent [19]

Anscher

[11] Patent Number: 6,049,951

[45] Date of Patent: Apr. 18, 2000

[54] SEWABLE TENSIONLOCK RETAINER

[75] Inventor: Joseph Anscher, Muttontown, N.Y.

[73] Assignee: National Molding Corp., Farmingdale, N.Y.

[21] Appl. No.: 08/995,657

[22] Filed: Dec. 22, 1997

[51] Int. Cl.[7] ..... A44B 11/04

[52] U.S. Cl. ..... 24/265 BC; 24/200

[58] Field of Search ..... 24/265 R, 265 AL, 24/265 BC, 265 A, 265 B, 265 EC, 265 H, 265 CD, 265 WS, 163 R, 198, 200; 2/336, 338, 311

[56] References Cited

U.S. PATENT DOCUMENTS 873,982 12/1907 Bloomberg ..... 24/265 BC
4,387,490 6/1983 Blackburn et al. ..... 24/200
4,799,298 1/1989 Matoba .
4,827,578 5/1989 Heckerman et al. ..... 24/265 A
4,843,689 7/1989 Fildan ..... 24/200

*Primary Examiner*—James R. Brittain
*Attorney, Agent, or Firm*—Kenyon & Kenyon

[57] ABSTRACT

A sewable tensionlock retainer for securing a tensionlock to a flexible article such as a strap. The retainer includes a tensionlock portion and a sewable funnel-shaped retainer portion having an internal cavity for receiving a flexible article. The retainer portion is provided with a sewing groove to receive stitches to permanently secure the flexible article in the internal cavity.

10 Claims, 5 Drawing Sheets

FIG. 7
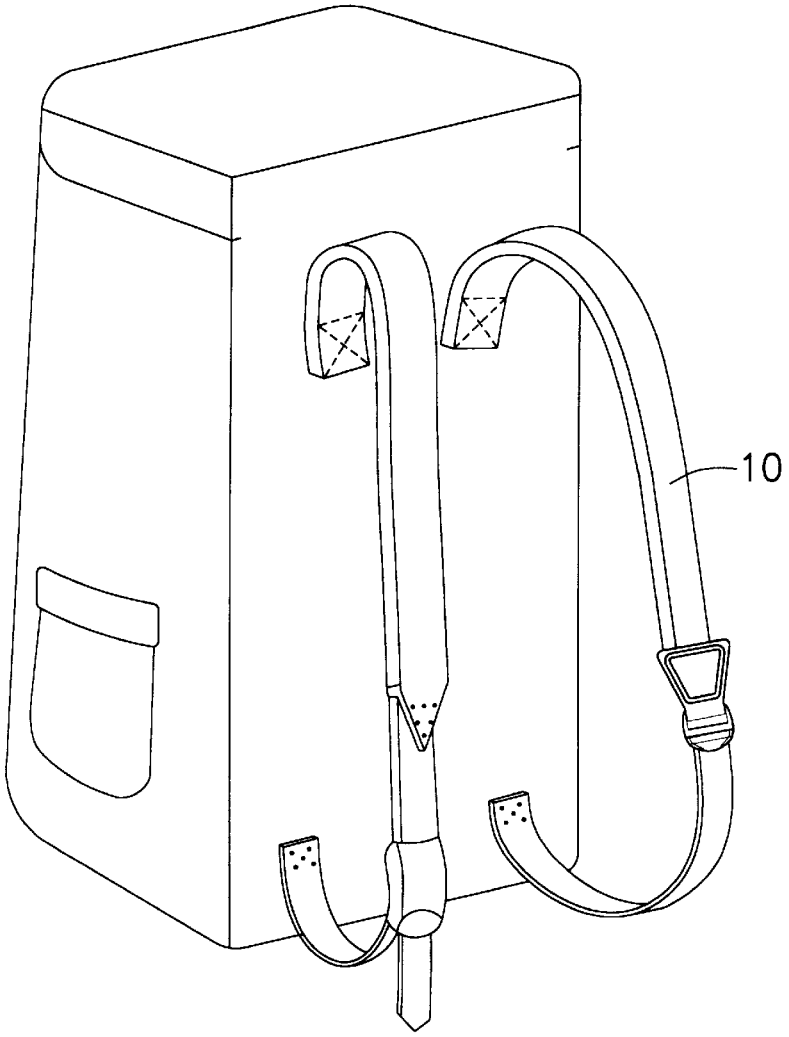
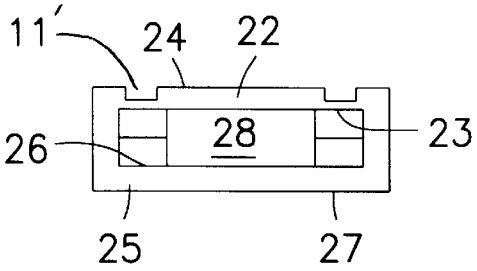
FIG. 10B

SEWABLE TENSIONLOCK RETAINER

FIELD OF INVENTION

The present invention relates generally to a device for selectively securing an elongated flexible article and more particularly to a sewable tensionlock retainer attached, e.g., to the base of a shoulder pad on a backpack.

BACKGROUND OF THE INVENTION

Various tensionlocks are known in the prior art.

One shortcoming of these prior art tensionlocks is that they may be complicated and, thus, expensive to manufacture.

Another shortcoming of these prior art devices is that it may be difficult or time consuming to introduce and secure the elongated flexible article or strap to the tensionlock.

Yet another shortcoming of prior art devices is that the portion securing the elongated flexible article or strap may present an unattractive or unfinished appearance.

SUMMARY OF THE INVENTION

It is an object of this invention to provide a tensionlock retainer for easily and quickly securing an elongated flexible article or strap that is simple and inexpensive to manufacture.

It is another object of this invention to provide a tensionlock retainer for securing an elongated flexible article or strap that presents an attractive and finished appearance.

It is yet another object of this invention to provide a tensionlock retainer that may be provided with an external indicia or marking, e.g., a label or other indicator of origin.

It is yet another object of this invention to provide a tensionlock retainer for securing an elongated flexible article or strap, comprising: a tensionlock portion having a first side member and a second side member and a plurality of cross-members disposed between and connecting common surfaces of the side members. A funnel-shaped retainer portion is attached to the tensionlock. The retainer portion is provided with an outer surface and an inner surface with the inner surface defining an internal cavity sized and adapted to receive an elongated flexible article. A sewing groove is disposed in the outer surface of the retainer portion and is sized and adapted to receive a plurality of stitches to secure the flexible article in the internal cavity.

It is still another object of this invention to provide a device for selectively securing an elongated flexible article or strap comprising: a tensionlock portion comprising a first side member and a second side member and a plurality of cross-members disposed between and connecting common surfaces of the side members. A funnel-shaped retainer portion is attached to the tensionlock. In a preferred embodiment the retainer portion is pivotally or hingedly connected to the tensionlock portion. The retainer portion comprises a first funnel shaped portion having a first major surface and a second major surface and a second funnel shaped portion having a first major surface and a second major surface. The first and the second funnel shaped portions are adapted for movement in a first direction towards each other to a first position and are also adapted for movement in a second direction away from each other to a second position. When the first major surfaces of the first and second funnel shaped portions are disposed in the first position they define an internal cavity sized and adapted to receive an elongated flexible article and when they are disposed in the second position they facilitate the introduction of an elongated flexible article between the first and second funnel shaped portions. A sewing groove may be disposed in at least one of the second major surfaces of the first and second funnel shaped portions and is sized and adapted to receive a plurality of stitches to secure the flexible article in the internal cavity.

It is a further object of this invention to provide a method of making a tensionlock retainer utilizing two molding machines comprising the steps of: molding a tensionlock portion in a first molding machine, the tensionlock portion having a first side member and a second side member and a plurality of cross-members disposed between and connecting common surfaces of the side members. The molded tensionlock portion is then transferred to a second molding machine and a retainer portion is then molded in the second machine. In a preferred embodiment, the retainer portion is comprised of a material having a melting or softening point that is lower than the melting or softening point of the material used to make the tensionlock portion. The retainer portion comprises a funnel-shaped retainer portion provided with an outer surface and an inner surface with the inner surface defining an internal cavity sized and adapted to receive an elongated flexible article. The retainer portion may be provided with a sewing groove that is sized and adapted to receive a plurality of stitches to secure the flexible article in the internal cavity. During the molding of the retainer portion it is simultaneously attached to the tensionlock portion. In a preferred embodiment the retainer portion is pivotally or hingedly attached to the tensionlock portion. In an especially preferred embodiment, a snap-fit engagement is utilized.

It is still another object of this invention to provide a method of making a tensionlock retainer utilizing a single molding machine having two injection cylinders comprising the steps of: first molding a tensionlock portion utilizing the first injection cylinder. The tensionlock portion comprises a first side member and a second side member and a plurality of cross-members disposed between and connecting common surfaces of the side members. A retainer portion is then molded utilizing the second injection cylinder. In a preferred embodiment, the retainer portion is comprised of a material having a melting or softening point that is less than the melting or softening temperature of the material comprising the tensionlock portion. The retainer portion is funnel-shaped and comprises a first funnel shaped portion having a first major surface and a second major surface and a second funnel shaped portion having a first major surface and a second major surface. The first and the second funnel shaped portions are adapted for movement in a first direction towards each other to a first position and are adapted for movement in a second direction away from each other to a second position. The first major surfaces of the first and second funnel shaped portions when disposed in the first position define an internal cavity sized and adapted to receive an elongated flexible article. The retainer portion may be further provided with a sewing groove disposed in at least one of the second major surfaces of the first and second funnel shaped portions. The sewing groove is sized and adapted to receive a plurality of stitches to secure the flexible article in the internal cavity. During the molding stage of the retainer portion it is simultaneously attached to the tensionlock portion. In a preferred embodiment the retainer portion is pivotally or hingedly connected to the tensionlock portion. In an especially preferred embodiment, a snap-fit connection is utilized.

BRIEF DESCRIPTION OF THE DRAWINGS

FIG. 7 shows the device shown in FIGS. 1–6 utilized on a back pack;

FIG. 10B is an end view of FIG. 10A and shows the internal cavity defined by the movable first and second funnel shaped portions;

DETAILED DESCRIPTION OF THE PREFERRED EMBODIMENTS

Figure 1:
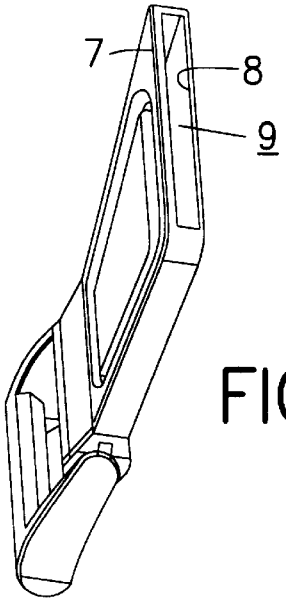
FIG. 1 is a perspective view of a tensionlock retainer constructed in accordance with the invention.
Figure 4:
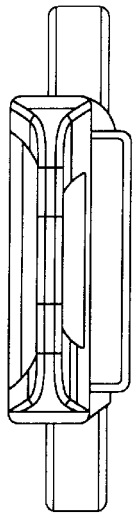
FIG. 4 is an end view of the tensionlock portion of the device shown in FIG. 2.
Figure 2:
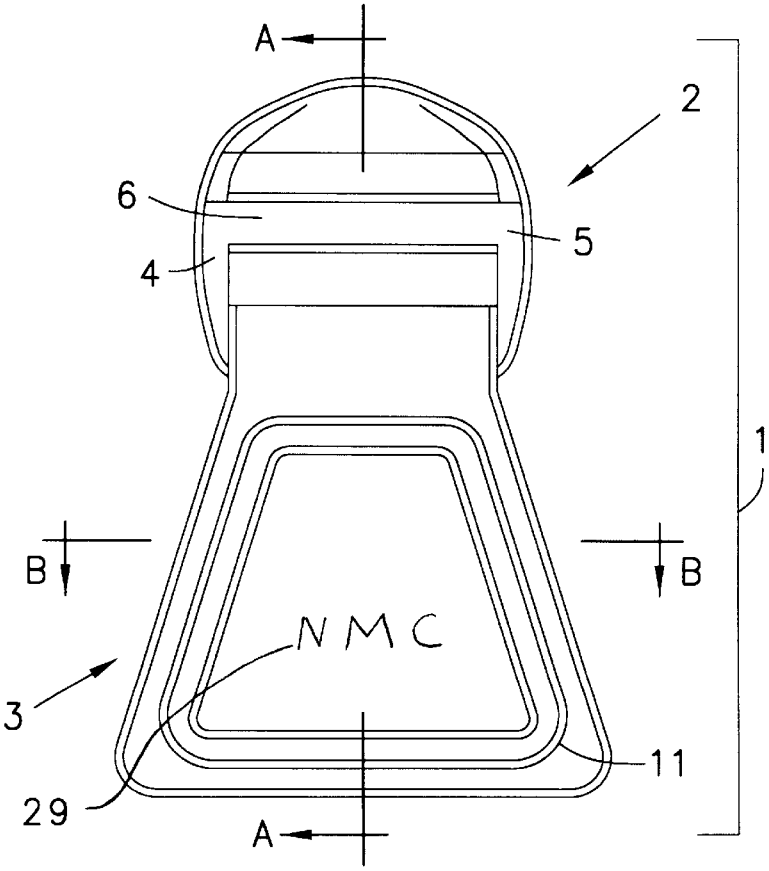
FIG. 2 is a top view of the device shown in FIG. 1.
Figure 5:
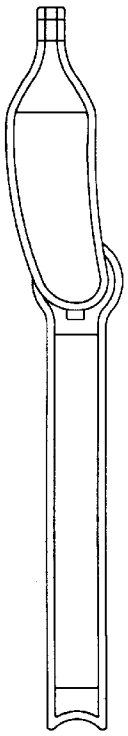
FIG. 5 is side view of FIG. 2.
Figure 6:
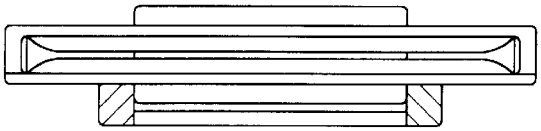
FIG. 6 is an end view of the funnel shaped retainer shown in FIG. 2.
Figure 3:
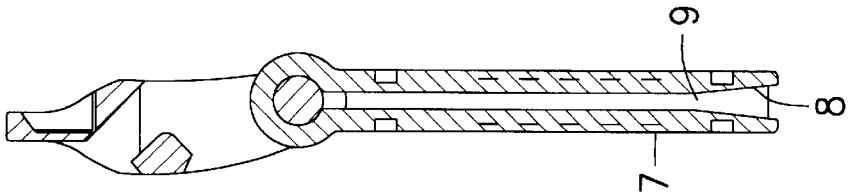
FIG. 3 is a cross-sectional side view taken along line A—A of the device shown in FIG. 2.
Figure 2A:
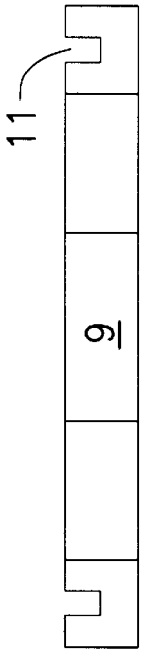
FIG. 2A is an end view taken along line B—B of FIG. 2.

FIGS. 1 to 6 show one embodiment of a sewable tensionlock retainer manufactured in accordance with the invention. FIG. 1 is a perspective view of a tensionlock retainer constructed in accordance with the invention and FIG. 2 is a top view of the device shown in FIG. 1. FIG. 2A is an end view taken along line B—B of FIG. 2 and FIG. 3 is a cross-sectional side view taken along line A—A of the device shown in FIG. 2. FIG. 4 is an end view of the tensionlock portion 2 of the device shown in FIG. 2, FIG. 5 is a side view of FIG. 2, and FIG. 6 is an end view of the funnel shaped retainer portion 3 shown in FIG. 2.

The sewable tensionlock retainer 1 comprises a tensionlock portion 2 and a retainer portion 3. The tensionlock portion 2 is comprised of a first side member 4 and a second side member 5 and at least one cross-member 6 disposed between the side members 4 and 5. The retainer portion 3 is funnel shaped and is attached to the tensionlock portion 2. The retainer portion 3 is provided with an outer surface 7 and an inner surface 8 defining an internal cavity 9 sized and adapted to receive an elongated flexible article such as a strap 10 (shown in FIG. 7). In an especially preferred embodiment the internal cavity 9 is funnel shaped. In a preferred embodiment, a sewing groove 11 (shown best in FIG. 2A taken along line B-B of FIG. 2) is disposed in the outer surface of the retainer portion and is sized to receive a plurality of stitches so that the flexible article 10 can be permanently secured in the internal cavity 9. Because of its decreased thickness the sewing groove 11 permits easier penetration by the needle during sewing and also serves to protect the stitches from abrasion during normal use. The retainer portion 3 and the tensionlock portion 2 may be made from a wide range of materials well known to those skilled in the art as suitable for this purpose, however, in a preferred embodiment the tensionlock portion 2 is comprised of a hard plastic and the retainer portion 3 is comprised of an elastomeric material. In an especially preferred embodiment the hard plastic is selected from the group consisting of nylon and acetal. In an especially preferred embodiment, the tensionlock portion 2 and the retainer portion 3 are comprised of materials having a different melting points. In an especially preferred embodiment, the material used to make the retainer portion has a melting or softening point that is lower than the melting or softening point of the material used to make the tensionlock portion. This permits the retainer portion to be hingedly or pivotally connected to the tensionlock portion while the retainer portion is molded without having the two portions fuse to each other. The tensionlock retainer may be provided with an external indicia or marking 29, e.g., a label or other indicator of origin, as shown in FIG. 2.

Figure 10A:
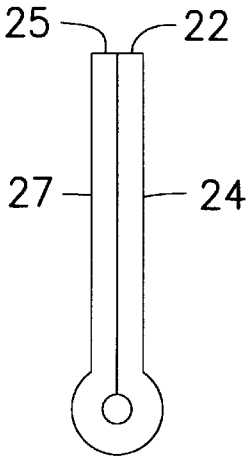
FIG. 10A shows the movable first and second funnel shaped portions of FIG. 10 disposed in the first position.
Figure 8:
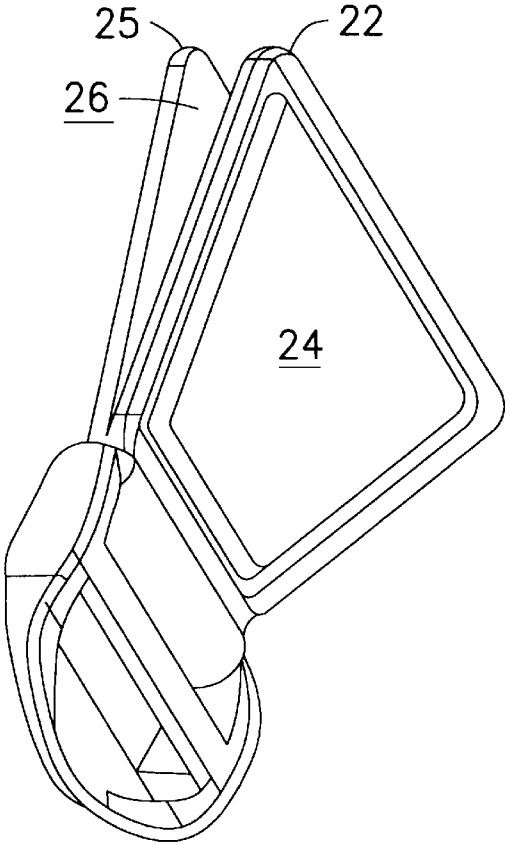
FIG. 8 shows a perspective view of an alternative embodiment of the invention.
Figure 12:
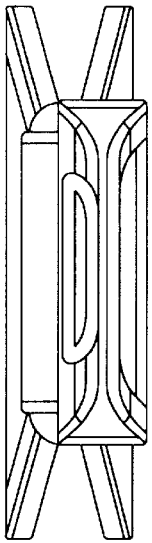
FIG. 12 is an end view of FIG. 8.
Figure 10:
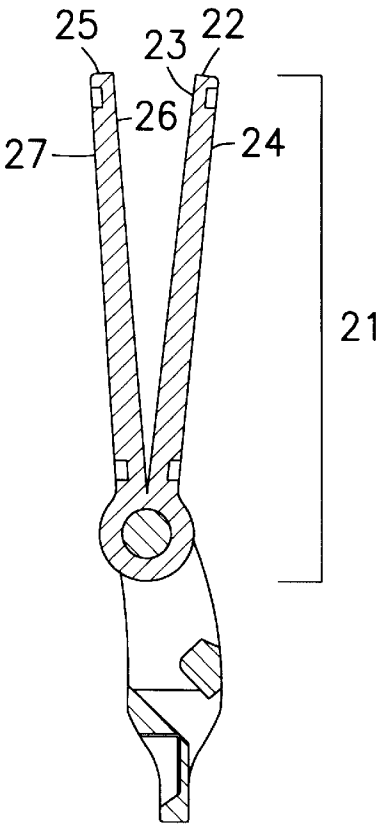
FIG. 10 is a cross-sectional side view taken along line A—A of FIG. 9 and shows the movable first and second funnel shaped portions disposed in the second position.
Figure 9:
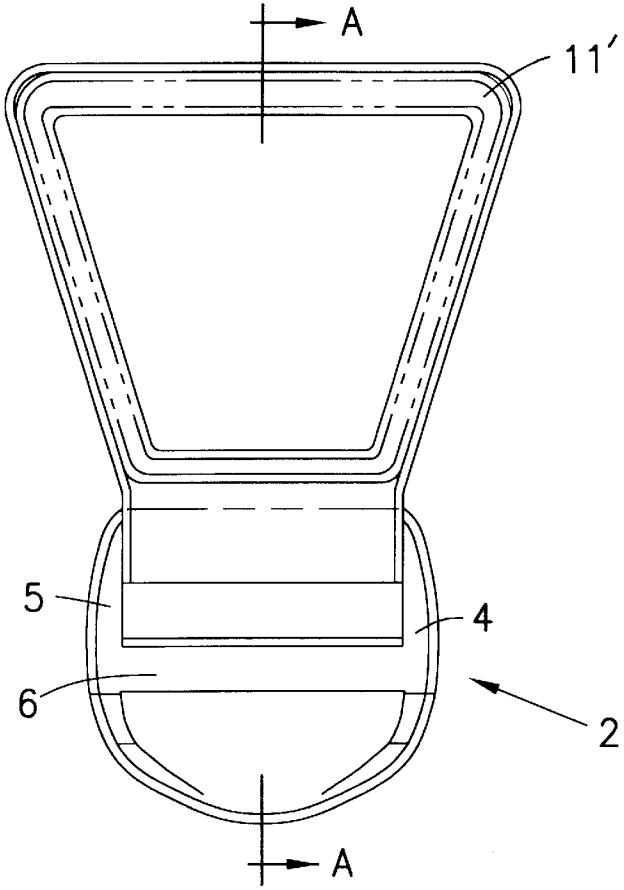
FIG. 9 is a top view of FIG. 8.
Figure 11:
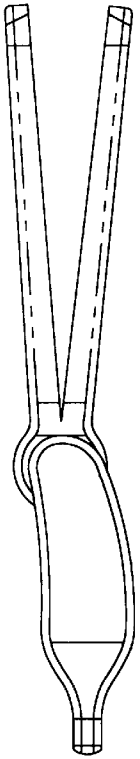
FIG. 11 is a side view of FIG. 8.

FIGS. 8 to 11 show another embodiment 20 of the present invention. FIG. 8 shows a perspective view of an alternative embodiment of the invention, and FIG. 9 is a top view of FIG. 8. FIG. 10 is a cross-sectional side view taken along line A—A of FIG. 9 and shows the movable first and second funnel shaped portions 22 and 25 disposed in the second position. FIG. 10A shows the movable first and second funnel shaped portions 22 and 25 of FIG. 10 disposed in the first position. FIG. 10B is an end view of FIG. 10A and shows the internal cavity 28 defined by the movable first and second funnel shaped portions 22 and 25. FIG. 11 is a side view of FIG. 8 and FIG. 12 is an end view of FIG. 8.

The tensionlock portion 2 is comprised of a first side member 4 and a second side member 5 and at least one cross-member 6 disposed between the side members 4 and 5. The retainer portion 21 comprises a first funnel shaped portion 22 having a first major surface 23 and a second major surface 24 and a second funnel shaped portion 25 having a first major surface 26 and a second major surface 27. The first and second funnel shaped portions 22 and 25 are adapted for movement in a first direction towards each other to a first position (shown in FIG. 10A) and are also adapted for movement in a second direction to a second position away from each other (shown in FIG. 10). FIG. 10B is an end view of FIG. 10A and shows that when the first and second funnel shaped portions 22 and 25 are disposed in the first position, the first major surface 23 of the first funnel shaped portion 22 and the first major surface 26 of the second funnel shaped portion 25 define an internal cavity 28 sized and adapted to receive an elongated article such as a strap 10. In a preferred embodiment, the internal cavity 28 is funnel shaped. In an especially preferred embodiment, at 20 least one of the second major surfaces 24 and 27 of the first and second funnel shaped portions 22 and 25 is provided with a sewing groove 11 as shown in FIG. 10B.

The tensionlock retainers 1 and 20 of this invention may be manufactured in a variety of ways well known to those skilled in the art as suitable for this purpose, however, in a preferred embodiment injection molding is utilized. In one especially preferred embodiment, the tensionlock portion is first molded in a first machine and is transferred to a second machine where the retainer portion is molded and simultaneously pivotally or hingedly attached to the tensionlock portion. In another especially preferred manufacturing method, a molding machine having first and second injection cylinders is utilized. The tensionlock portion is first made utilizing one of the injection cylinders. The retainer portion is then made and simultaneously pivotally or hingedly attached to the tensionlock portion utilizing the second injection cylinder. In an especially preferred embodiment, the material used to form the tensionlock portion has a melting or softening temperature that is higher than the melting or softening point of the material used to form the retainer portion. In an especially preferred manufacturing method, the retainer portion is formed and pivotally or hingedly attached to the tensionlock portion at a temperature sufficiently high to permit the retainer lock portion to be molded and at a temperature sufficiently low so that the tensionlock portion does not melt or soften. In an especially preferred embodiment, the retainer portion is comprised of a material having a lower melting or softening point than the material used to make the tensionlock portion.

Although the present invention has been described in specific and detailed terms with respect to the preferred embodiments as set forth above, various other embodiments of this invention including alterations in size, shape, etc., substitutions of conventional elements and other applications will be readily apparent to those with ordinary skill in the art without departing from the broader spirit and scope of the invention as set forth in the appended claims. Therefore, the specification is to be regarded in an illustrative rather than restrictive sense.

What is claimed is:

1. A sewable tensionlock retainer for securing a tensionlock to a flexible article, comprsing:

a) a tensionlock portion having a first side member and a second side member and a plurality of cross-members disposed between and connecting common surfaces of the side members; and b) a funnel-shaped retainer portion attached to the tensionlock, the retainer portion provided with an outer surface and an inner surface, the inner surface defining an internal cavity sized and adapted to receive an elongated flexible article, wherein the tensionlock portion is comprised a hard plastic and the retainer portion is comprised of an elastomeric material.

2. The tensionlock retainer of claim 1, wherein the plastic is selected from the group consisting of nylon and acetal.

3. The tensionlock retainer of claim 1, further comprising:

a sewing groove disposed in the outer surface of the retainer portion, the sewing groove sized and adapted to receive a plurality of stitches to secure the flexible article in the internal cavity.

4. The tensionlock retainer of claim 1, wherein the retainer portion is pivotally or hingedly attached to the tensionlock portion.

5. A sewable tensionlock retainer for securing a tensionlock to a flexible article, comprising:

a) a tensionlock portion comprising a first side member and a second side member and a plurality of cross-members disposed between and connecting common surfaces of the side members;

b) a funnel-shaped retainer portion attached to the tensionlock, the retainer portion comprising a first funnel shaped portion having a first major surface and a second major surface, the first and the second funnel shaped portions adapted for movement in a first direction towards eachother to a first position and adapted for movement in a second direction away from eachother to a second position, the first major surfcaes of the first and second funnel shaped portions when disposed in the first position defining an internal cavity sized and adapted to receive an elongated flexible article, wherein the tensionlock portion comprises a hard plastic and the retainer portion is comprised of an elastomeric material.

6. The tensionlock retainer of claim 5, wherein the plastic is selected from the group consisting of nylon and acetal.

7. The tensionlock retainer of claim 5, further comprising:

a sewing groove disposed in at least one of the second major surfaces of the first and second funnel shaped portions, the sewing groove sized and adapted to receive a plurality of stitches to secure the flexible article in the internal cavity.

8. The tensionlock retainer of claim 5, wherein the retainer portion is pivotally or hingedly attached to the tensionlock portion.

9. The tensionlock retainer of claims, 1 or 5 wherein the retainer portion is comprised of material having a lower melting or softening temperature than the material comprising the tensionlock portion.

10. The tensionlock retainer of claims 1 or 5, further comprising external indicia disposed on the retainer portion.

* * * * *

UNITED STATES PATENT AND TRADEMARK OFFICE

CERTIFICATE OF CORRECTION

PATENT No. : 6,049,951

DATED : April 18, 2000

INVENTOR(S): Joseph Anscher

It is certified that error appears in the above-identified patent and that said Letters Patent is hereby corrected as shown below:

Col. 6, line 40, delete "1 or 5" and insert --2 or 5--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*